US006612724B2

(12) United States Patent
Lin

(10) Patent No.: US 6,612,724 B2
(45) Date of Patent: Sep. 2, 2003

(54) DETACHABLE LAMPSHADE FOR A LAMP

(76) Inventor: Po-Chen Lin, 5F, No. 16, Alley 3, Lane 742, Chungcheng Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/039,096

(22) Filed: Jan. 2, 2002

(65) Prior Publication Data

US 2003/0123256 A1 Jul. 3, 2003

(51) Int. Cl.[7] ..... F21V 1/06; F21V 11/00

(52) U.S. Cl. ..... 362/352; 362/356; 362/357; 362/358; 362/410; 362/433; 362/450

(58) Field of Search ..... 362/351, 352, 362/355, 356, 357, 410, 433, 450, 353, 358

(56) References Cited

U.S. PATENT DOCUMENTS 4,277,823 A * 7/1981 Suzuki ..... 362/352
6,386,739 B1 * 5/2002 Wu ..... 362/450
6,443,599 B1 * 9/2002 Wu ..... 362/352
6,443,601 B1 * 9/2002 Wu ..... 362/352
2002/0118543 A1 * 8/2002 Wu

* cited by examiner

*Primary Examiner*—Stephen Husar
*Assistant Examiner*—Sharon Payne

(57) ABSTRACT

A lampshade has a frame and a shade. The frame has an upper collar, a lower collar and multiple supporting frames. The upper collar is attached to the stand of the lamp. The supporting frames are detachably mounted between the upper collar and the lower collar. Each supporting frame has an upper section, two side rods and a lower section. The lower section is connected to the side rods at the end far away from the upper section. The lower section abuts against the top of the lower collar. Such a lampshade can be disassembled into multiple parts whereby it is detachable to reduce the lampshade in size. Thus, to store and to transport the lampshade are convenient.

3 Claims, 4 Drawing Sheets

DETACHABLE LAMPSHADE FOR A LAMP

BACKGROUND OF THE INVENTION

1. Field of the Invention

The present invention relates to a lampshade, and more particularly to a detachable lampshade for a lamp to minimize the storage space required by the lampshade when not in use.

2. Description of Related Art

A lamp such as a table lamp or a stand lamp substantially comprises a stand, a bulb and a lampshade. The lampshade is mounted on the stand and covers the bulb to avoid someone touching the hot bulb and to increase the beauty of the appearance of the lamp. The conventional lampshade comprises a frame and a shade. The frame is attached to the stand of the lamp. The shade is mounted on the frame to cover the bulb.

However, because the conventional frame is an integral structure, the frame of the conventional lampshade cannot be disassembled and reassembled easily. Packing and storing the lampshade is inconvenient because the lampshade is large and cannot be temporarily reduced in size. This is especially important in a retail store where space for stock is limited and thus expensive. For example, if a lampshade becomes very popular and the limited existing stock sells out quickly, further customers will be disappointed by not being able to make the purchase.

To overcome the shortcomings, the present invention tends to provide a lampshade to mitigate or obviate the aforementioned problems.

SUMMARY OF THE INVENTION

The main objective of the invention is to provide a lampshade that is detachable to reduce the lampshade in size. The lampshade has a frame and a shade. The frame has an upper collar, a lower collar and multiple supporting frames. The upper collar is attached to the stand of the lamp. The supporting frames are detachably mounted between the upper collar and the lower collar to connect the upper collar and the lower collar. Each supporting frame has an upper section, two side rods and a lower section. The upper section abuts against the bottom of the upper collar. Each side rod extends from one end of the upper section. The lower section is connected to the side rods at the end far away from the upper section. The lower section abuts against the top of the lower collar. Accordingly, the lampshade can be disassembled into multiple parts whereby the packaging and storing of the lampshade are reduced.

Other objects, advantages and novel features of the invention will become more apparent from the following detailed description when taken in conjunction with the accompanying drawings.

DETAILED DESCRIPTION OF PREFERRED EMBODIMENT

Figure 1:
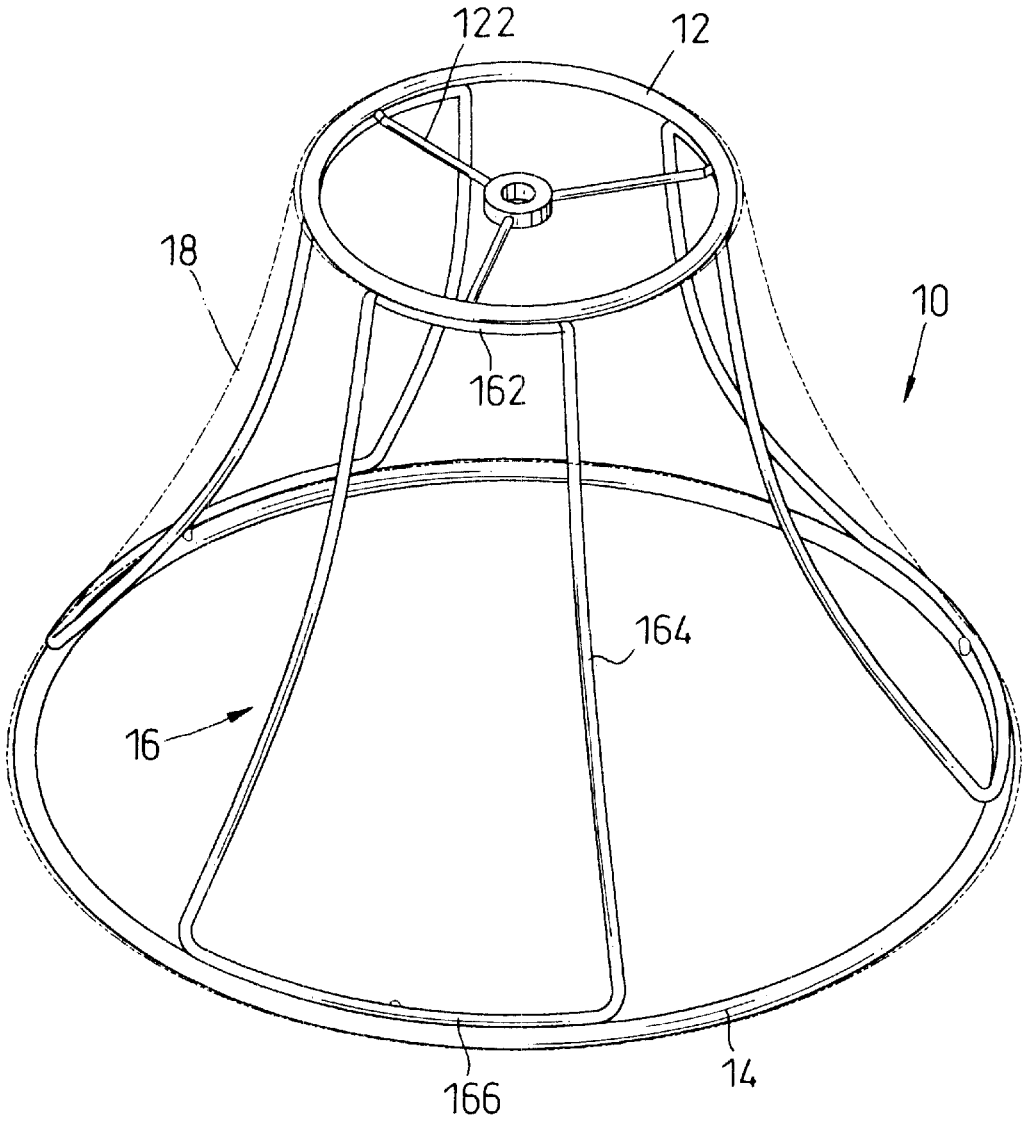
FIG. 1 is a perspective view of a lampshade in accordance with the present invention.
Figure 2:
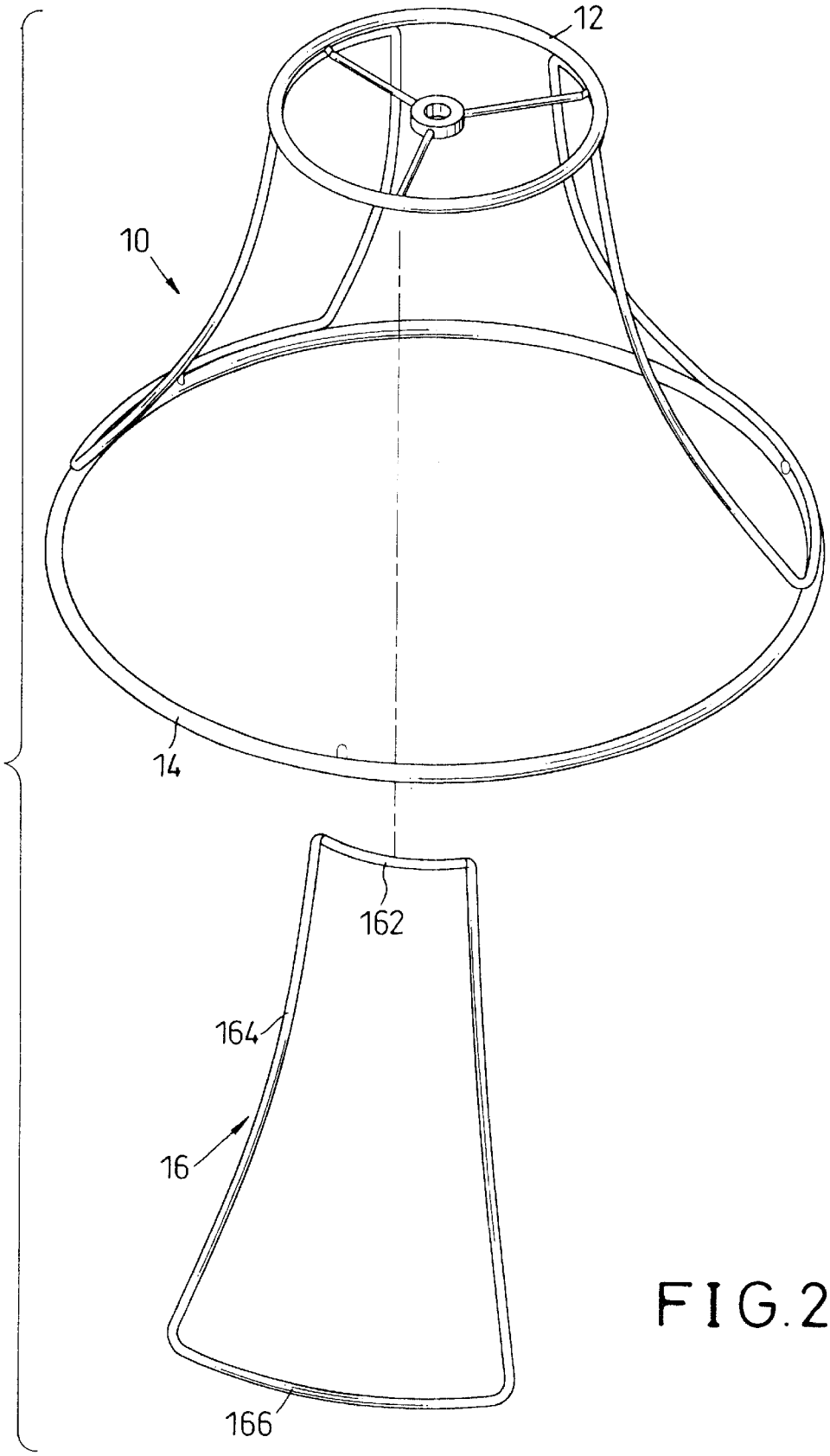
FIG. 2 is an exploded perspective view of the lampshade in FIG. 1.

With reference to FIGS. 1 and 2, a lampshade in accordance with the present invention comprises a frame (10) and a shade (18). The frame (10) has an upper collar (12), a lower collar (14) and multiple supporting frames (16). A bracket (122) is mounted on the upper collar (12) to connect with the stand of the lamp, such that the upper collar (12) is mounted on the stand of the lamp with the bracket (122). The lower collar (14) is arranged below the upper collar (12). The supporting frames (16) are detachably mounted between the upper collar (12) and the lower collar (14) to connect the upper collar (12) and the lower collar (14). Each supporting frame (16) comprises an upper section (162), two side rods (164) and a lower section (166). The upper section (162) abuts against the bottom of the upper collar (12). The two side rods (164) respectively extend downward from two ends of the upper section (162). The lower section (166) is connected to the two side rods (164). In a first embodiment, the lower section (166) is integrally connected to the side rods (164). The lower section (166) is adapted to abut against the top of the lower collar (14). Each supporting frame (16) has a flexibility to be longitudinally compressed.

The shade (18) is made of a flexible material and is mounted on the frame (10) to cover the frame (10). It is to be noted that the shade usually has a length marginally smaller than the length of the frame (10) such that when the frame is completed the shade is held in tension and follows the configuration of the side rods (164).

To assemble the lampshade, the upper collar (12) and the lower collar (14) are securely attached to two ends of the shade (18) in advance. The supporting frames (16) are put between the upper collar (12) and the lower collar (14). The upper section (162) of each supporting frame (16) is put to abut against the bottom of the upper collar (12). The lower section (166) of each supporting frame (16) is put to abut against the top of the lower collar (14). Consequently, the supporting frames (16) can push the upper collar (12) and the lower collar (14) apart, and the shade (18) is then expanded to a desired shape.

To disassemble the lampshade, because both the upper section (162) and lower section (166) of each supporting frame (16) just abut against the upper collar (12), and the lower collar (14), the supporting frames (16) can be easily disassembled from the upper collar (12) and the lower collar (14). The upper collar (12), the lower collar (14) and the shade (18) can be folded to a flat condition after the supporting frames (16) are released. The lampshade is detachable, and the package and the storage of the lampshade are reduced whereby to store and to transport the lampshade are convenient.

Figure 3:
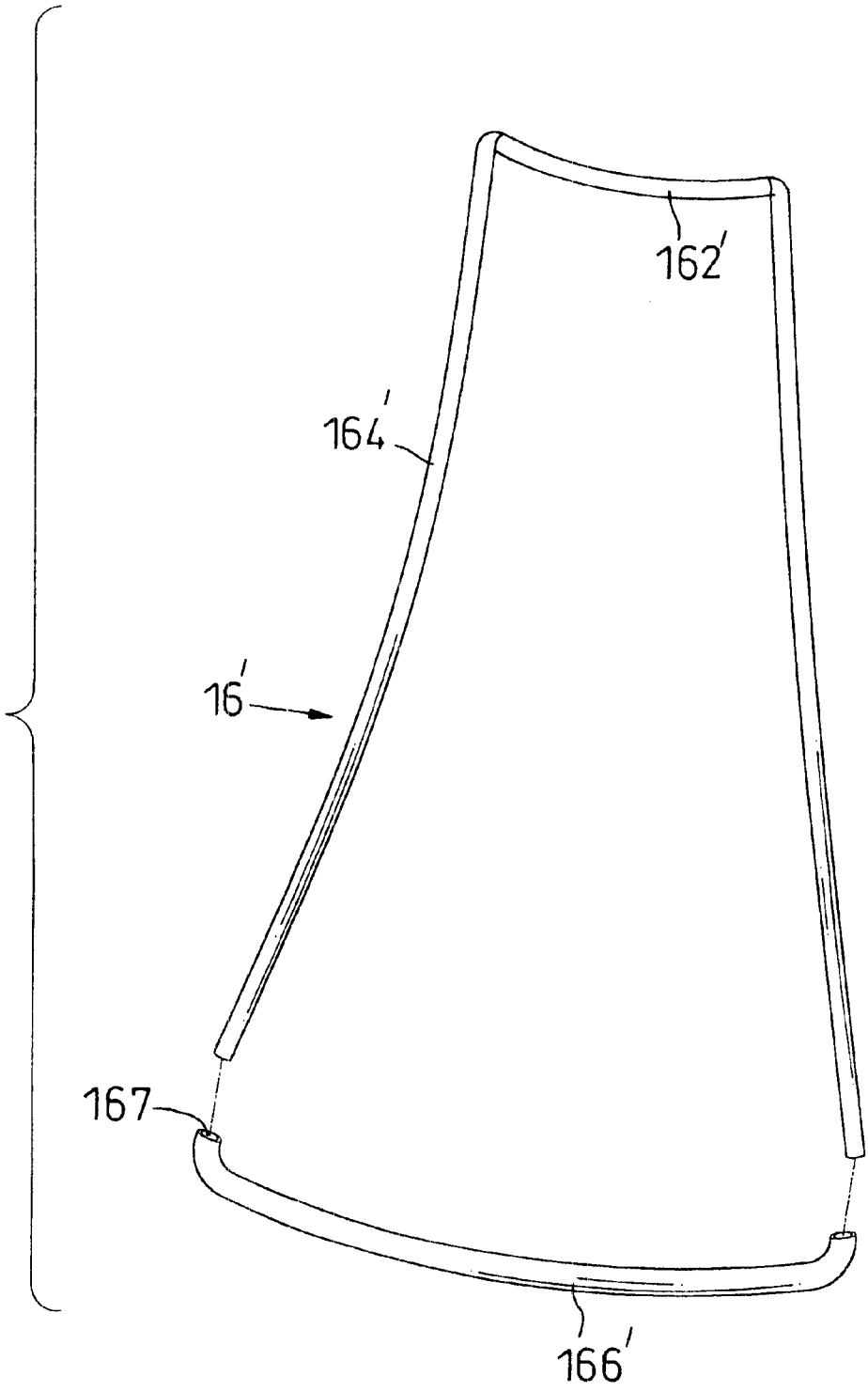
FIG. 3 is an exploded perspective view of a second embodiment of the supporting frame of the lampshade in accordance with the present.
Figure 4:
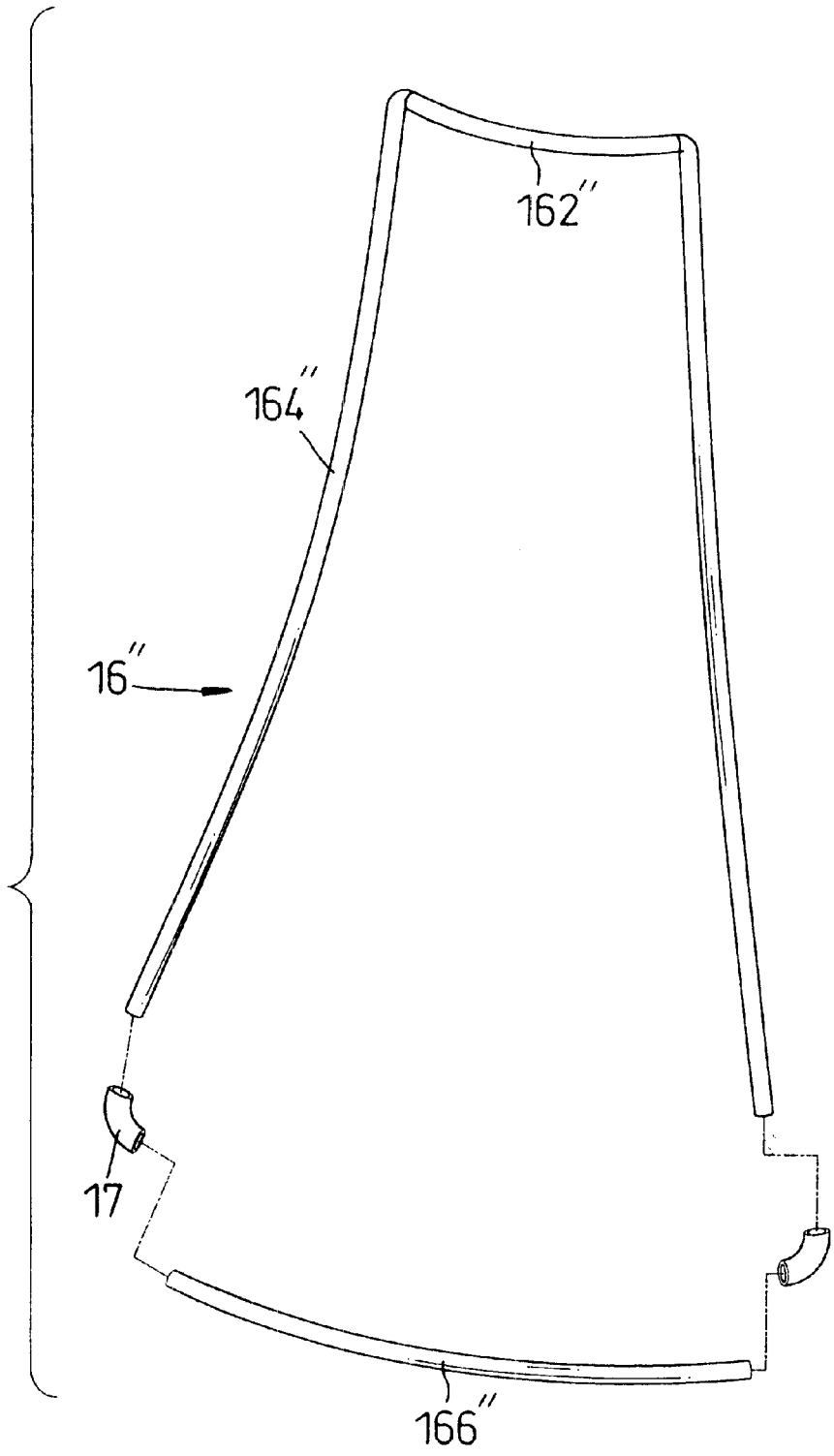
FIG. 4 is an exploded perspective view of a third embodiment of the supporting frame of the lampshade in accordance with the present invention.

In a second embodiment, with reference to FIG. 3, the supporting frames (16') each have the lower section (166') detachably attached to the two side rods (164'). Two holes (167) are defined in two ends of the lower section (166') to respectively engage with the free ends of the two side rods (164').

In a third embodiment, the supporting frames (16") each have an L-shaped connector (17) mounted between one of the side rods (164") and one end of the lower section (166"). Two holes are defined in two ends of the connector (17) to respectively engage with the free end of the corresponding rod (164") and one end of the lower section (166") to connect the lower section (166") to the side rod (164").

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lampshade for a lamp comprising:

a frame having:

an upper collar adapted to be mounted on a stand of the lamp;

a lower collar arranged below the upper collar; and multiple supporting frames detachably mounted between the upper collar and the lower collar to connect the upper collar and the lower collar; and a flexible shade mounted on the frame to cover the frame, wherein each supporting frame has:

an upper section abutting a bottom of the upper collar;

two side rods respectively extending from two ends of the upper section; and a lower section connecting the two side rods to abut a top of the lower collar wherein the lower section is detachably attached to the two side rods.

2. The lampshade as claimed in claim 1, wherein the lower section has a hole defined in each respective end of the lower section to engage a free end of one of the side rods.

3. The lampshade as claimed in claim 1 further comprising an L-shaped connector having two holes defined in two ends of the connector, the holes respectively engaging a free end of one of the side rods and one end of the lower section to connect the lower section to the side rod.

* * * * *